United States Patent [19]

Ahern et al.

[11] Patent Number: 4,575,222

[45] Date of Patent: Mar. 11, 1986

[54] APPARATUS FOR ACCURATELY FORMING COLOR-CORRECTED ELECTROGRAPHIC IMAGES

[75] Inventors: Douglas K. Ahern; Alphonse B. DiFrancesco, both of Rochester, N.Y.

[73] Assignee: Eastman Kodak Company, Rochester, N.Y.

[21] Appl. No.: 683,742

[22] Filed: Dec. 19, 1984

[51] Int. Cl.[4] ..... G03G 15/01

[52] U.S. Cl. ..... 355/4; 355/3 SH; 355/14 SH; 271/112; 271/225

[58] Field of Search ..... 355/4, 3 R, 3 SH, 14 SH; 235/304, 301; 271/225, 112, 110, 10; 118/630; 271/245, 253, 247, 254, 258

[56] References Cited

U.S. PATENT DOCUMENTS

| | | | |
|---|---|---|---|
| 3,187,651 | 6/1965 | Eichorn et al. | 118/630 |
| 3,936,179 | 2/1976 | Murakami | 355/11 |
| 4,017,171 | 4/1977 | Wick et al. | 355/4 |
| 4,188,213 | 2/1980 | Lehman | 355/4 X |
| 4,256,298 | 3/1981 | Ahern | 271/245 |
| 4,456,363 | 6/1984 | Hirabayashi | 355/3 SH X |
| 4,477,176 | 10/1984 | Russel | 355/4 X |
| 4,480,906 | 11/1984 | Titus et al. | 355/3 R |
| 4,487,407 | 12/1984 | Baldwin | 355/3 SH X |
| 4,506,978 | 3/1985 | Alloco, Jr. | 355/3 SH X |
| 4,525,057 | 6/1985 | Kaufmann et al. | 355/3 SH X |

*Primary Examiner*—A. C. Prescott
*Attorney, Agent, or Firm*—Lawrence P. Kessler

[57] ABSTRACT

An electrographic multi-color copier capable of color correcting electrographic images formed on discrete dielectric sheets, and including improved apparatus for transporting and accurately registering selected ones of such sheets relative to others during color correction. Selected dielectric sheets are respectively transported at a predetermined linear speed along first and second travel paths associated with the color correction apparatus. A first registration mechanism is selectively movable to a position intercepting the first travel path upstream of such color correction apparatus for registering the sheet relative to such apparatus, and a position remote from such path. A second registration mechanism is selectively movable to a position intercepting the second travel path upstream of such color correction apparatus for registering such other sheet relative to such apparatus, and a position remote from such path. The first and second registration mechanisms are simultaneously moved from their path intercepting positions to their remote positions after respective registration of the transported sheets. Such sheets are then respectively transported to the color correction apparatus at the same linear speed and are thus in accurate registration relative to one another during color correction.

12 Claims, 7 Drawing Figures

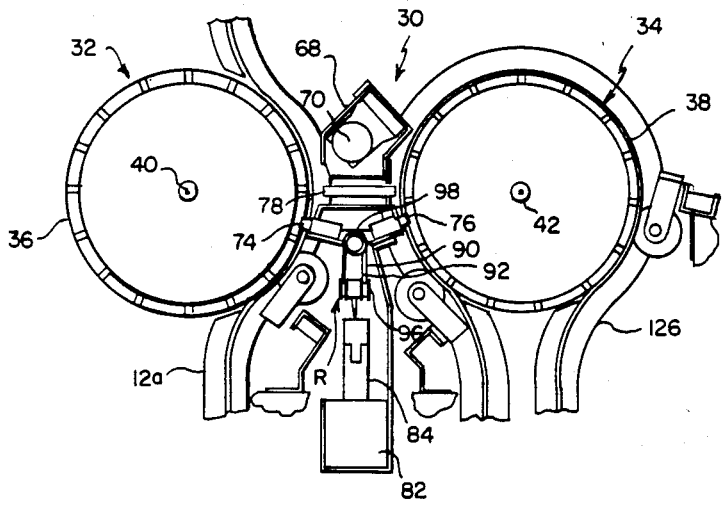
FIG. 2
FIG. 4
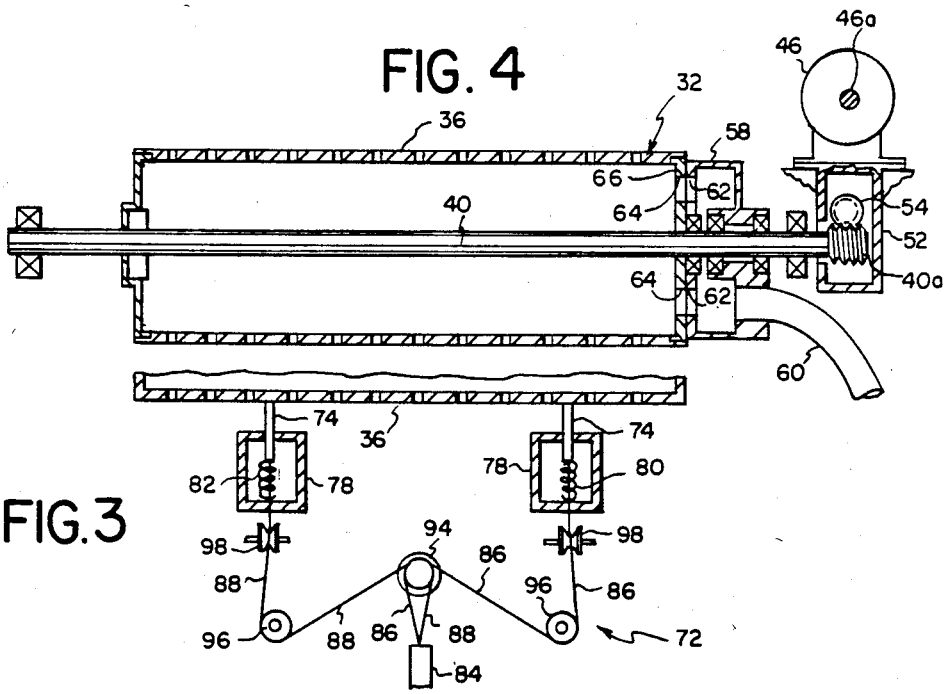
FIG.3

APPARATUS FOR ACCURATELY FORMING COLOR-CORRECTED ELECTROGRAPHIC IMAGES

BACKGROUND OF THE INVENTION

This invention relates generally to apparatus for forming multi-color electrographic images, and more particularly, to apparatus for accurately forming color-corrected electrographic images.

Electrographic technology commonly employed in making monochrome reproductions has recently been adapted to the making of multi-color reproductions. Examples of reproduction apparatus using such technology in the making of multi-color reproductions is shown in U.S. Pat. Nos. 3,841,751, issued Oct. 15, 1974 in the name of Draugelis et al., and 4,436,405, issued Mar. 14, 1984 in the name of Kindt. In such apparatus, discrete areas of a uniformly charged dielectric member (or discrete dielectric members) are electrographically processed to alter such charge to form charge patterns corresponding respectively to color separation images (e.g., red, green, blue) of multi-color information to be reproduced. The charge patterns are then developed respectively with complementary colored electroscopic marking particles (e.g., cyan, magenta, yellow) and successively transferred in accurate superimposed register to a receiver sheet to form the multi-color reproduction.

One problem encountered in obtaining faithful multi-color reproductions using electrographic apparatus is related to light absorption characteristics of the electroscopic marking particles. For example, cyan pigments or dyes used in such particles often exhibit unwanted green and blue light absorption in addition to desired red light absorption. Similarly, magenta pigments or dyes used in such particles often exhibit unwanted blue light absorption in addition to desired green light absorption. If the unwanted light absorptions are not accounted for (corrected), the produced multi-color reproduction can be degraded in the fidelity of its color saturation and hue.

A related problem is that of exposure error of the red, green and blue information in the multi-color information being reproduced. There are usually side absorptions in the dyes, inks or toners used in such information. That is, when the charge patterns are formed by exposure through a color-separation filter system, and such system is not precisely matched for a particular input colorant set, the amount of cyan, magenta and yellow marking particles used in the reproduction will not be precisely proportional to the amount of cyan, magenta and yellow colorant in the information being reproduced. For example, the amount of yellow particles used in the reproduction will include an amount in proportion to the amount of yellow colorant in the information being reproduced plus amounts in proportion to the amounts of cyan and magenta colorant in such information weighted by their respective blue absorptions within the passband of the blue color-separation filter which is used. Imperfect matching of the blue filter to the input colorants can cause the amount of yellow marking particles used to differ from the amounts of such input colorants in the information being reproduced, thereby degrading the saturation and hue fidelity of the reproduction relative to such information.

A variety of solutions have been suggested for "color correction" of unwanted light absorptions of the marking particle colorants. For example, U.S. Pat. Nos. 3,615,391; 3,836,244 and 3,844,783 disclose color correction techniques wherein an element bearing an electrostatic mask pattern is placed into facing relation with a photoconductor sector which bears an electrostatic color-separation image. Development then occurs with the two electrostatic patterns competing for marking particles. Alternatively, an approach similar to graphics arts masking can be used. This involves forming a negative masking marking particle image and exposing the electrostatic color-separation image to the information being reproduced through the masking image. These techniques involve additional steps, are difficult to control accurately, and are difficult to implement in an automated machine.

U.S. Pat. No. 4,236,809 suggests performing color correction of a color-separation electrostatic image by selectively discharging it with a scanning laser beam (controlled in accordance with an electrical signal obtained from a previous electro-optic scan of the information being reproduced). U.S. Pat. No. 4,090,876 discloses a device using first and second ion modulating screens to form and color correct electrostatic color-separation images. Both of these latter approaches involve complex and expensive equipment additions to the electrographic apparatus, with the inevitably coupled problems in maintenance and reliability.

A much simplified solution to color correction is described in the commonly assigned U.S. patent application Ser. No. 493,867, filed May 12, 1983, in the name of Spitzner et al. According to the disclosure of such application, a plurality of photoconductor sectors are exposed to multi-color information to be reproduced through a plurality of primary color filters respectively to form electrostatic charge patterns corresponding to color separation images of such information. A charge pattern of a first color-separation image is developed with pigmented marking particles of one color (e.g., cyan). A reflected light image of such developed charge pattern exposes, in register, the charge pattern of another color-separation image (e.g., pattern formed with a green filter) prior to development with its respective pigmented marking particles of another color (e.g., magenta). Such exposures provides the desired color correction by altering the subsequent charge pattern in a manner which proportionally reduces the amount of marking particles utilized in developing such pattern by a degree which substantially compensates for the unwanted light absorption characteristics of the marking particles of the previously developed charge pattern. The accuracy of registration between the developed image and a subsequent charge pattern during color correction exposure is essential in obtaining the desired alteration of such charge pattern. In the embodiments of the Spitzner et al application where discrete photoconductor sheets are utilized, the sheets are shuttled along complex paths and precise registration for color correction is not necessarily ensured.

SUMMARY OF THE INVENTION

This invention is directed to an electrographic multi-color copier capable of color correcting electrographic images formed on discrete dielectric sheets, and including improved apparatus for transporting and accurately registering selected ones of such sheets relative to others during color correction. Selected dielectric sheets are respectively transported at a predetermined linear speed along first and second travel paths associated with the color correction apparatus. A first registration mechanism is selectively movable to a position intercepting the first travel path upstream of such color correction apparatus for registering the sheet relative to such apparatus, and a position remote from such path. A second registration mechanism is selectively movable to a position intercepting the second travel path upstream of such color correction apparatus for registering such other sheet relative to such apparatus, and a position remote from such path. The first and second registration mechanisms are simultaneously moved from their path intercepting positions to their remote positions after respective registration of the transported sheets. Such sheets are then respectively transported to the color correction apparatus at the same linear speed and are thus in accurate registration relative to one another during color correction.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings in which:

FIG. 2 is an end elevational view, partly in cross-section and on an enlarged scale, of the color correction apparatus and its associated sheet registration mechanism according to this invention;

FIG. 3 is a side elevational view, partly in cross-section, of the actuator for the registration pins of the sheet registration mechanism of FIG. 2 with portions removed to facilitate viewing;

FIG. 4 is a side elevational view, partly in cross-section of a sheet advancing roller of the sheet registration mechanism of FIG. 2 with portions removed to facilitate viewing;

DESCRIPTION OF THE PREFERRED EMBODIMENT

Figure 1:
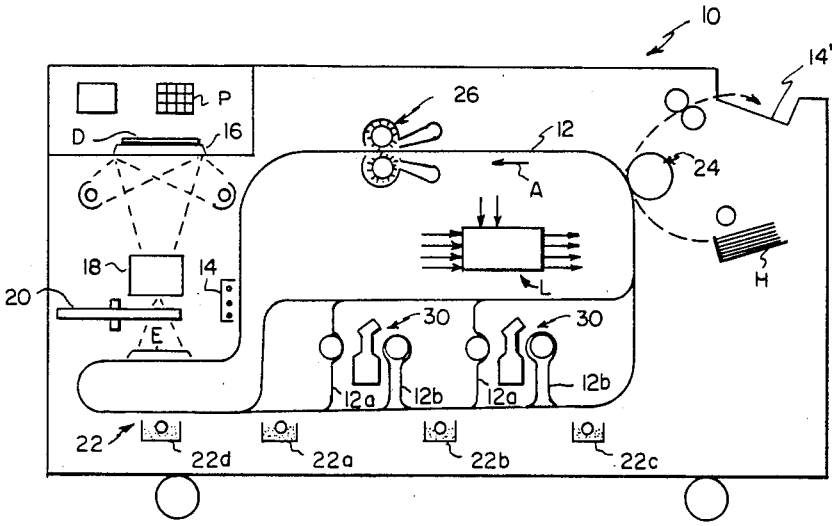
FIG. 1 is a schematic illustration of a multi-color copier utilizing discrete dielectric sheets upon which electrographic images are formed and including apparatus for the color correction of such images.

Referring now to the accompanying drawings, FIG. 1 shows a multi-color copier, designated generally by the numeral 10, utilizing discrete dielectric sheets upon which electrographic images are formed. While the copier 10 is hereinafter described in sufficient detail for a full understanding of this invention, a more detailed disclosure of a similar copier may be found in aforementioned U.S. Pat. No. 4,436,405. The copier 10 includes a track assembly 12 describing a travel path about which discrete dielectric sheets are transported seriatim, in the direction of arrow A, by a suitable drive mechanism (not shown) such as nip drive rollers, for example. The sheets respectively include substantially transparent photoconductive, grounding and support layers, such as described in U.S. Pat. No. 3,615,414, issued Oct. 26, 1971 in the name of Light.

In order, the dielectric sheets are directed through electrographic process stations of the copier 10 where operations thereon are controlled by the logic and control unit L of the copier. The logic and control until L includes, for example, a microprocessor receiving input signals from an operator control panel P and timing signals from sensors (not shown) detecting the positional presence of the sheets as they are transported about the travel path described by the track assembly 12. Based on such signals and a program for the microprocessor, the unit produces signals to control the timing of operation of the various electrographic process stations for carrying out the reproduction process. The production of a program for a number of commercially available microprocessors such an INTEL model 8080 or model 8085 microprocessor (which along with others are suitable for use with the invention), is a conventional skill well understood in the art. The particular details of any such program would, of course, depend on the architecture of the selected microprocessor.

In a typical electrographic process, a grounded discrete dielectric sheet is transported past a corona charger 14, where it receives a uniform electrostatic charge, to an exposure zone E. In the exposure zone, the sheet is exposed to selectively alter the uniform charge to form a latent image charge pattern corresponding, image-wise, to information to be reproduced. In the illustrative embodiment, exposure is accomplished by directing a reflected light image from a document D supported on a transparent platen 16 through a lens 18 and a filter wheel 20 to a sheet in the exposure zone E. Of course, other optical or electrical arrangements for forming an imagewise charge pattern of information to be reproduced on the sheet are suitable for use with this invention.

After the latent image charge pattern is formed on the sheet, the sheet is transported through a developer station 22. In the developer station, the pattern is developed by electrostatically adhering pigmented electroscopic marking particles to the pattern by a magnetic brush developer, for example, to form a visible transferable image on such sheet. The sheet bearing a transferable image is then transported through a transfer apparatus 24 where the image is electrostatically transferred to a receiver member (e.g. cut sheet of plain paper) fed to the transfer apparatus from a supply hopper H. The transfer apparatus 24 is, for example, of the type described in U.S. Pat. No. 4,410,263 issued Oct. 18, 1983 in the name of Gustafson et al. After transfer, the sheet is transported through a cleaning station 26, where any residual marking particles are removed, and returned to the vicinity of the charger 14 for reuse. Concurrently, the receiver member, bearing the transferred image, is transported through a fuser station 28 where such image is fixed to such member by heat and/or pressure and delivered to an exit hopper H' for operator retrieval.

For each monochromatic reproduction to be made, one reflected light image of the document is passed through a neutral density sector of the filter wheel to expose one dielectric sheet. The charge pattern formed on the sheet by such exposure is developed, for example, by magnetic brush developer **22*d* in station 22** to form the transferable image. On the other hand, for each multi-color reproduction to be made, a plurality of reflected light images of the document are successively passed through different color sectors of the filter wheel to expose a plurality of sheets respectively. With a subtraction color reproduction process, the color sectors of the filter wheel are of primary colors respectively. The charge patterns formed on the sheets by such exposures are then respectively developed with complementary colored marking particles to form color-separation transferable images.

Development of the latent image charge patterns is accomplished by directing the pattern-carrying sheets respectively through branched portions of the track assembly 12 into operative association with magnetic brush developers 22*a*–22*c*, for example, of developer station 22. The magnetic brush developers 22*a*–22*c* contain electroscopic marking particles of a respective color corresponding to the complement of a primary color. Sheets exposed to a certain primary color are then directed into association with the developer containing particles of the color complementary to that primary color. During transfer, the receiver member is retained in the transfer station 24 and the transferable images are transferred sequentially from the respective sheets to the member in accurate superimposed register to form a composite multi-color image on such member. Of course, if the reproduction is to contain information reproduced as black, a magnetic brush developer (e.g., developer 22*d*), containing black marking particles, may also be used to develop a charge pattern (related to the charge patterns produced by exposure through the color filter sectors) exposed bn a sheet through a neutral density filter sector. The black transferable image is also transferred to the receiver member in accurate superimposed register.

The apparatus for accomplishing color correction of the electrographic images on the discrete dielectric sheets, designated generally by the numeral 30, is located between developers 22*a* and 22*b* and between developers 22*b* and 22*c* (see FIG. 1). The apparatus 30 are of identical construction and therefore only one such apparatus is described with reference to FIGS. 2 through 7. Apparatus 30 has associated therewith a first track portion 12*a* and a second track portion 12*b*. Track portion 12*a* directs a transported sheet bearing a developed image from the developer where such image was developed (e.g., developer 22*a*) through apparatus 30 toward transfer station 24. On the other hand, track portion 12*b* directs a subsequent transported sheet bearing an undeveloped charge pattern through apparatus 30 toward the developer where such image is to be developed (e.g., developer 22*b*).

The track portions 12*a* and 12*b* are respectively associated with sheet advancing rollers 32 and 34 to which discrete sheets are secured during operation of the color correction apparatus 30 (see FIG. 2). The sheet advancing rollers respectively include ported cylinders 36 and 38. Cylinder 36 is concentrically supported on, and keyed to, a shaft 40 for rotation with such shaft (see FIG. 4); while cylinder 38 is similarly concentrically supported on, and keyed to, a shaft 42 for rotation with such shaft. The shafts 40 and 42 extend through end caps of their respective cylinders and are supported in bearings mounted on the frame (not shown) of the copier 10. Shaft 40 has a helical gear 40*a* formed at one end thereof and shaft 42 has a helical gear 42*a*, of equal pitch but opposite hand, formed at a like end thereof. The helical gears are driven in unison by a mechanism 44 to rotate the cylinder 36 and 38 in opposite directions (i.e., cylinder 36 is driven counterclockwise and cylinder 38 is driven clockwise in FIGS. 2 and 5) at a predetermined angular velocity of equal magnitude.

Figure 5:
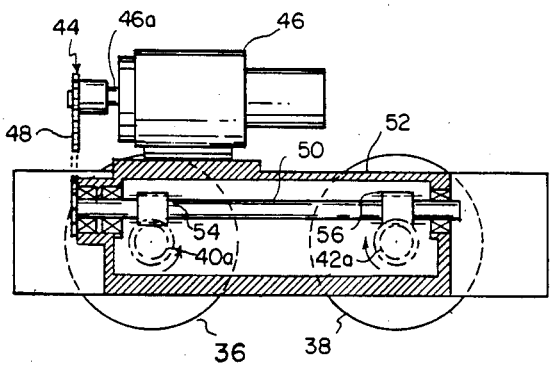
FIG. 5 is an end elevational view, partly in cross-section of a drive mechanism for the sheet advancing rollers.
Figure 6:
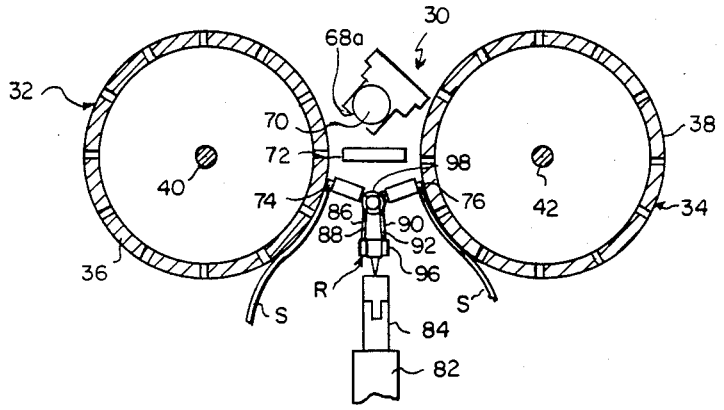
FIGS. 6 and 7 are end elevational views, similar to FIG. 2, with portions removed to facilitate viewing, taken at different times in the sequence of operation of the color correction apparatus and its associated sheet registration mechanism according to this invention.
Figure 7:
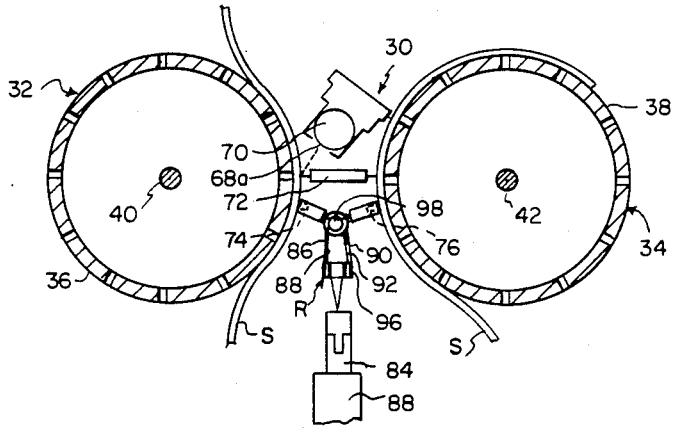

The drive mechanism 44 includes a rotary motor 46, the output shaft 46*a* of which is coupled by a chain drive 48 to a shaft 50 (see FIG. 5). The shaft 50 is mounted for rotation in bearings supported in a housing 52. The housing 52 also supports motor 46 and receives helical gears 40*a* and 42*a*. The shaft 50 includes helical gears 54 and 56, of equal pitch but opposite hand, which mate with helical gears 40*a* and 42*a* respectively to rotate the gears 40*a*, 42*a* in unison but opposite directions as the motor 46 rotates. The cylinders are thus rotated in opposite directions at a predetermined angular velocity of equal magnitude.

Stationary vacuum manifolds are supported on shafts 40 and 42 in juxtaposition with cylinders 36 and 38 respectively. The manifolds are connected to a vacuum source and have openings communicating with openings in the adjacent end caps of such cylinders respectively (see FIG. 4, for example, in which manifold 58 has a vacuum connection 60 and openings 62 communicating with openings 64 in end cap 66 of cylinder 36). As such, the vacuum is effective to tack discrete dielectric sheets to the surfaces of such ported cylinders. Accordingly, such sheets are transported by the respective cylinders with an equal predetermined linear speed through the apparatus 30.

The apparatus 30 further includes a housing 68 located between the track portions 12*a* and 12*b*. An elongated lamp 70, having its longitudinal axis parallel to the axes of cylinders 36 and 38, is mounted in the housing 60. Light from such lamp is directed through an opening 68*a* toward the surface of cylinder 36. An elongated lens 72 (for example, a fiber optics lens) is mounted in the housing 68 to lie in a plane including the longitudinal axes of cylinders 36 and 38. Thus, light scattered from a line segment of a developed image on a discrete dielectric sheet supported on the cylinder 36 is focused on a line segment of a discrete dielectric sheet supported on the cylinder 38 as the sheets are moving through the respective track portions 12*a*, 12*b*.

Since the surface of the sheet bearing the developed image and the surface of the sheet bearing the undeveloped charge pattern are facing in the same direction, when the sheets are in accurate registration, the line segment of the developed image focused through the transparent sheet bearing the undeveloped charge pattern corresponds point-by-point to the undeveloped charge pattern. As described above, the scattered light therefore effects color correction by reducing the undeveloped charge pattern on the sheet tacked to cylinder 38 in a manner which proportionally reduces the amount of marking particles utilized in developing such pattern by a degree which substantially compensates for unwanted light absorption characteristics of the marking particles in the developed image. That is to say, light scattered from the image on the sheet developed by developer 22*a* (e.g., cyan image) effects color correction of the undeveloped image to be developed by developer 22*b* (e.g., magenta image); and light scattered from the image on the sheet developed by developer 22*b* (e.g., magenta image) effects color correction of the undeveloped image to be developed by developer 22*c* (e.g., yellow image).

In order to ensure such registration of the moving discrete dielectric sheets, a registration mechanism R is mounted in the housing 68. The registration mechanism R includes a first pair of retractable registration pins 74 located in juxtaposition with cylinder 36 (one pin shown in FIG. 2), and a second pair of retractable registration pins 76 located in juxtaposition with cylinder 38 (one pin shown in FIG. 2). The pins of each pair of pins are aligned on an element of their respective associated cylinder and are spaced on opposite sides of the transverse centerline of such cylinder (i.e., the centerline of the discrete dielectric sheet travel path) as shown in FIG. 3. Such element of each cylinder is parallel to, and spaced an equal distance from, the line where a plane through the lens 72 intersects such cylinders. The elements thus respectively define a registration location for a sheet relative to the lens 72. The pins 74 are slidably mounted in receptacles 78 and urged by springs 80 into engagement with the surface of cylinder 36 (pins 76 are similarly mounted for urging into engagement with the surface of cylinder 38). By such engagement, the pairs of pins respectively block the travel paths of the sheets vacuum tacked to the cylinders 36, 38 (see FIG. 6). When the sheets, moving respectively through track portions 12*a*, 12*b* are tacked to the cylinders, they are moved into engagement with the registration pins. The pins hold the sheets at the registration location against further movement (the sheets slipping on the surfaces of the rotating cylinders or rotation of the cylinders being interrupted) until the pins are retracted.

Retraction of the pairs of pins 74, 76 is accomplished by a solenoid 82 mounted in the housing 68. The solenoid 82 has a retractable armature 84 connected by flexible, dimensionally stable, lines 86, 88, 90 and 92 of equal length to the pins respectively. The flexible lines are entrained over pulleys 94, 96 and 98 so that the force exerted on the lines by retraction of the solenoid armature 84 acts to retract all of the pins, against the urging of springs 80, at the same time. Thus, the pins are all retracted in unison. The solenoid 82 is responsive to an appropriate signal from the logic and control unit L to effect retraction of the armature 84, and thus the pins, at a predetermined time. Therefore, when the pins are retracted, the sheets tacked to the respective cylinders 36, 38 are transported by such cylinders as the cylinders rotate, and the sheets are respectively moved past the lens 72 at an equal linear speed. The sheets are thus in registration with respect to one another (see FIG. 7) as they are transported through the color correction apparatus 30 so that color correction is accurately accomplished in the above-described manner.

After color correction the sheet on cylinder 36 is guided by track portion 12*a* away from such cylinder and is transported to the transfer station 24. On the other hand, the sheet on cylinder 38 is guided by track portion 12*b* away from such cylinder and transported to the appropriate developer for development of the color-corrected image thereon. After development, the sheet is then transported to a subsequent color correction apparatus 30 to serve as the sheet carrying the developed image (e.g., to apparatus 30 between developer 22*b* and 22*c*), or directly to the transfer station 24 (e.g., after development at developer 22*c*). As the respective sheets clear the apparatus 30, the armature 84 of solenoid 82 is extended to enable the pairs of pins 74, 76 to return to engagement with the cylinders 36, 38, respectively, the pins are thus positioned for registration of subsequent sheets delivered to the apparatus for color correction.

The invention has been described in detail with particular reference to a preferred embodiment thereof, but it will be understood that variations and modifications can be effected within the spirit and scope of the invention.

We claim:

1. In a multi-color copier for forming electrographic images on discrete dielectric sheets and having means for color correcting such images, an improved means for transporting and accurately registering selected ones of such sheets relative to others during color correction, said transporting and registering means comprising:

first means for transporting a sheet at a predetermined linear speed along a first travel path associated with said color correction means;

a first registration mechanism selectively movable to a position intercepting such first travel path, upstream of said color correction means, for registering a sheet transported by said first transport means relative to such color correction means, and a position remote from such path;

second means for transporting another sheet at the same predetermined linear speed along a second travel path associated with said color correction means;

a second registration mechanism selectively movable to a position intercepting such second travel path, upstream of said color correction means, for registering the sheet transported by said second transport means relative to such color correction means, and a position remote from such path; and means for simultaneously moving said first registration mechanism and said second registration mechanism from their path intercepting positions to their remote position, after respective registration of transported sheets, whereby such sheets are respectively transported to such color correction means at the same linear speed and are thus in accurate registration relative to one another during color correction.

2. The invention of claim 1 wherein said respective transport means include a rotatable cylinder, means for attaching a sheet to the peripheral surface of such cylinder for movement therewith, and means for rotating said respective cylinders about their longitudinal axes at an angular velocity of equal magnitude but in opposite directions.

3. The invention of claim 2 wherein said first registration mechanism includes at least one pin associated with one of said cylinders and means for urging said pin into engagement with the peripheral surface of such cylinder, and said second registration mechanism includes at least one pin associated with the other of said cylinders and means for urging said pin into engagement with the peripheral surface of such other cylinder.

4. The invention of claim 3 wherein said simultaneous moving means includes means coupled to said pins and selectively actuatable for simultaneously moving said pins, against the urging of said urging means, away from the respective cylinder peripheral surfaces with which such pins are associated.

5. The invention of claim 2 wherein the longitudinal axes of said rotatable cylinders are parallel and lie in a plane including said color correction means, whereby said first and second travel paths are parallel at their crossing of such plane.

6. The invention of claim 5 wherein said first registration mechanism includes at least one pin, and means for urging said pin into engagement with the peripheral surface of one of said cylinders a preselected distance about such peripheral surface upstream of said plane; and wherein said second registration mechanism includes at least one pin, and means for urging said pin into engagement with the peripheral surface of the other of said cylinders an equal preselected distance about such peripheral surface upstream of said plane, whereby sheets respectively registered by said registration mechanisms are registered with respect to said color correction means and with respect to one another.

7. The invention of claim 6 wherein said simultaneous moving means includes a selectively actuatable solenoid having a reciprocable armature and a plurality of flexible, dimensionally stable lines coupled to said armature and to said pins of said first and second registration mechanisms respectively, whereby when said solenoid is actuated to reciprocate said armature in one direction, said lines simultaneously move said pins against the urging of said urging means away from the respective cylinder peripheral surfaces with which such pins are in engagement.

8. A multi-color copier including means for electrographically forming color separation images on discrete dielectric sheets and developing such images with complementary colored marking particles respectively, and means for color correcting selected ones of such images, said color correction means comprising:

first means for transporting a sheet bearing a first color-separation image, which has been developed with marking particles of a first color, along a first travel path at a predetermined linear speed;

second means for transporting a sheet bearing an undeveloped second color-separation image along a second travel path, associated with such first travel path, at the same predetermined linear speed;

exposure means, located between said first and second travel paths, for (1) optically exposing a sheet in said first travel path to a light source, (2) collecting light scattered from the developed first color separation image on such sheet, and (3) exposing a sheet in said second travel path to such collected light to alter its undeveloped second color separation image in proportion to such collected light;

first registration means, associated with such first travel path upstream of said exposure means, for selectively registering a sheet transported by said first transport means along such first travel path relative to said exposure means;

second registration means, associated with such second travel path upstream of said exposure means, for selectively registering a sheet transported by said second transport means along such second travel path relative to said exposure means; and means for activating said first and second registration means to simultaneously release sheets respectively registered by said first and second registration means, whereby such sheets are respectively transported at such equal predetermined linear speed past said exposure means in accurate registration relative to one another so that proper color correction of the second color-separation image on the sheet in such second travel path is effected prior to its development by marking particles of a second color.

9. The invention of claim 8 wherein said respective transport means include a rotatable cylinder, means for attaching a sheet to the peripheral surface of such cylinder for movement therewith, and means for rotating said respective cylinders about their longitudinal axes at an angular velocity of equal magnitude but in opposite directions.

10. The invention of claim 9 wherein the longitudinal axes of said rotatable cylinders are parallel and lie in a plane including said exposure means whereby said first and second travel paths are parallel at their crossing of such plane.

11. The invention of claim 10 wherein said first registration means includes at least one pin, and means for urging said pin into engagement with the peripheral surface of one of said cylinders a preselected distance about such peripheral surface upstream of said plane; and wherein said second registration mechanism includes at least one pin, and means for urging said pin into engagement with the peripheral surface of the other of said cylinders an equal preselected distance about such peripheral surface upstream of said plane, whereby sheets respectively registered by said registration mechanisms are registered with respect to said color correction means and with respect to one another.

12. The invention of claim 11 wherein said activating means includes a selectively actuatable solenoid having a reciprocable armature and a plurality of flexible, dimensionally stable lines coupled to said armature and to said pins of said first and second registration means respectively, whereby when said solenoid is actuated to reciprocate said armature in one direction, said lines simultaneously move said pins against the urging of said urging means away from the respective cylinder peripheral surfaces with which such pins are associated.

* * * * *